United States Patent [19]

Pedersen

[11] Patent Number: 4,665,856

[45] Date of Patent: May 19, 1987

[54] MOORING APPARATUS

[75] Inventor: Kristen I. Pedersen, Houston, Tex.

[73] Assignee: SOFEC, Inc., Houston, Tex.

[21] Appl. No.: 783,454

[22] Filed: Oct. 3, 1985

[51] Int. Cl.[4] ..... B63B 22/02

[52] U.S. Cl. ..... 114/230; 441/3; 441/4

[58] Field of Search ..... 114/230; 441/3, 4, 5, 441/2; 212/191, 195, 196

[56] References Cited

U.S. PATENT DOCUMENTS

| | | | |
|---|---|---|---|
| 4,010,500 | 3/1977 | Reid | 441/5 |
| 4,098,213 | 7/1978 | Kemper et al. | 114/230 |
| 4,309,955 | 1/1982 | Kentosh | 114/230 |
| 4,351,260 | 9/1982 | Tuson et al. | 114/230 |
| 4,516,942 | 5/1985 | Pedersen | 441/5 |
| 4,530,302 | 7/1985 | Pedersen | 114/230 |

FOREIGN PATENT DOCUMENTS

| | | | |
|---|---|---|---|
| 0076341 | 10/1981 | European Pat. Off. . | |
| 0096119 | 12/1983 | European Pat. Off. . | |
| 0105976 | 4/1984 | European Pat. Off. . | |
| 105976 | 4/1984 | European Pat. Off. | 114/230 |
| 2136375 | 9/1984 | United Kingdom | 114/230 |

*Primary Examiner*—Joseph F. Peters, Jr.
*Assistant Examiner*—Thomas J. Brahan
*Attorney, Agent, or Firm*—Dodge, Bush & Moseley

[57] ABSTRACT

A structure for mooring a vessel floating on the surface of a body of water is disclosed including a tower structure and an improved structure for pivotably connecting the vessel to the tower structure while providing a restoring force to the vessel. The tower has a slewing boom rotatably mounted about its vertical axis. The longitudinal axis of the slewing boom is substantially aligned with that of the vessel. Pendant members are connected along the longitudinal axis of the slewing boom and support lateral members of a counterweight frame. Longitudinal members of the frame hold counterweight blocks. A unitary yoke is pivotably removably hinged at its tower end to one of the lateral members of the frame and is hinged at its vessel end to bow hinge brackets fixed to the vessel.

8 Claims, 5 Drawing Figures

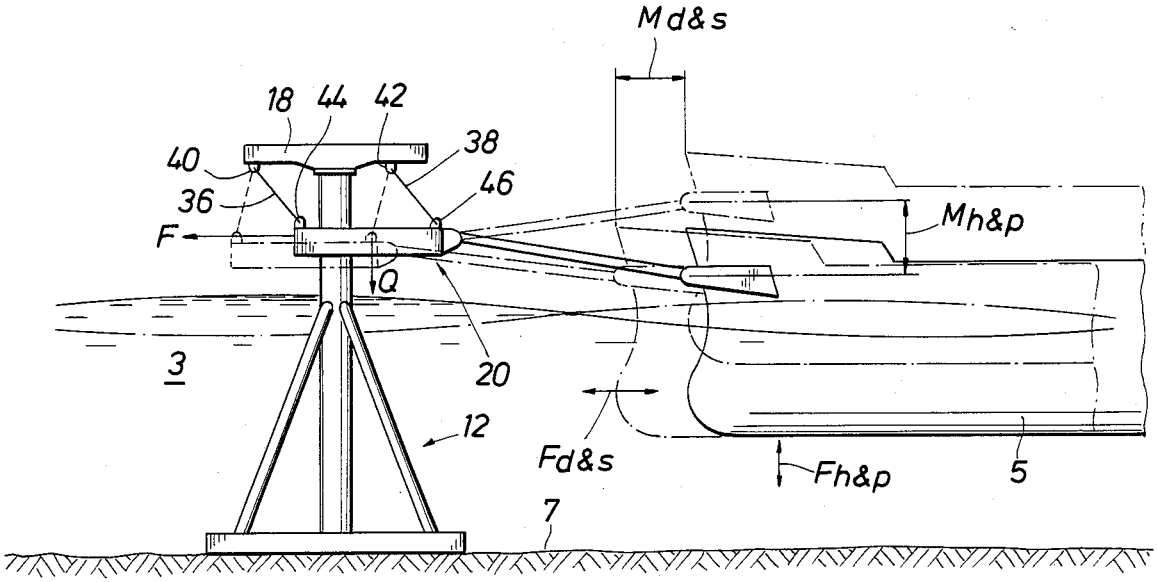
FIG. 3
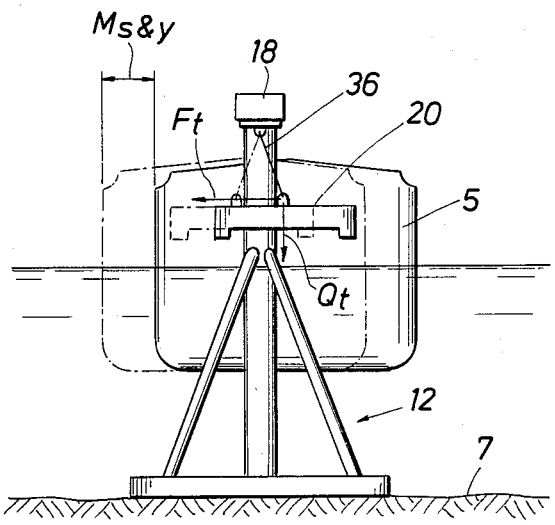
FIG. 4
FIG. 5
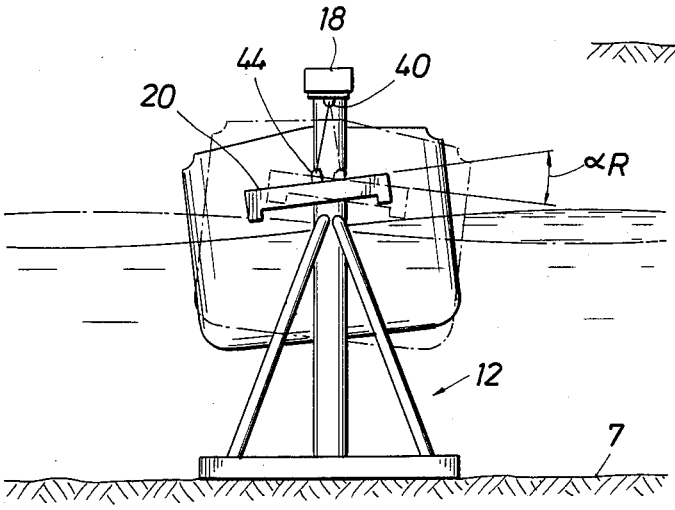

MOORING APPARATUS

BACKGROUND OF THE INVENTION

1. Field of the Invention

This invention relates generally to mooring structures and in particular to a single point mooring structure. More particularly, the invention relates to a tower apparatus having an improved structure for connecting the vessel to the tower.

2. Description of the Prior Art

Mooring systems which include a rigid arm connected to a chain anchored buoy or similar compliant mooring point to allow for the independent motion of the vessel are well known. Tower structures have been proposed by which a vessel is connected to a fixed tower by complaint means which allows freedom of motion between the tower structure and the vessel while providing restoring force and movement of the vessel with respect to the tower and which prevents collision between the vessel and the tower under any combination of wind, waves and current.

A published patent application of the European Patent Office, Publication Number 0105976, published Apr. 25, 1984, (hereafter the Willem Van Heijst publication) describes a single point mooring tower structure. The Van Heijst publication describes a tower structure fixed to the floor of the body of water. The vessel is connected to the tower by means of a pair of rigid arms, each of which is hinged at its vessel end to the vessel, to allow independent pivoting about two axes which are nearly parallel to the horizontal or lateral axis of the tower.

The Van Heijst tower structure includes a turntable rotatable about a vertical axis. Each rigid arm is connected to the tower by means of a tension member. Each tension member is connected between a point along the lateral axis of the turntable and one of the rigid arms. Hinges are provided to allow the rigid arms to pivot about the lateral axis with respect to the tension members. Hinges are also provided to allow the tension arms to pivot about the lateral axis and the longitudinal axis with respect to the turntable. Ballast weights are connected to the tension members.

While the Van Heijst structure has advantages over other prior art tower mooring structures, improvements in its design are desirable. For example, roll motions of the vessel will cause a twisting effect at the hinges connecting the rigid arms to the tension members which cannot be safely accommodated without significant modifications to the hinge arrangements. Also the Van Heijst structure requires two separate yoke frames, each with two large capacity hinges at the tanker end. A single yoke frame, as in the present invention, requires only two hinges at the tanker end resulting in both initial cost savings and reduced maintenance requirements.

IDENTIFICATION OF OBJECTS OF THE INVENTION

An object of this invention is to provide an improved tower mooring structure.

Another object of this invention is to provide an improved tower mooring structure which will allow for all movements of the vessel, including roll movements, while minimizing structural forces and stresses due to such movements.

Another object of this invention is to provide an improved tower mooring structure having a single rigid arm connecting the vessel and the tower.

Still another object of this invention is to provide a tower mooring system having an efficient position restoring system which may easily be connected and disconnected for vessel arrival and departure.

SUMMARY OF THE INVENTION

The objects outlined above, as well as other advantages and features of the invention, are achieved in a structure for mooring a vessel. A tower structure is fixed to the floor of the body of water on which the vessel is floating. A slewing boom has a longitudinal axis, substantially aligned with the longitudinal axis of the vessel, and a lateral axis, each of which is orthogonal to the vertical axis of the tower structure.

A counterweight frame is provided having a first pair of longitudinal members disposed parallel to the longitudinal axis of the slewing boom, and a pair of lateral members disposed parallel to the lateral axis. A pair of suspension pendants is connected between the lateral members and the slewing boom. The suspension pendants are connected along the longitudinal axis of the slewing boom. Counterweights are placed in slots provided along the longitudinal members of the frame.

A single yoke is pivotably connectable at its vessel end to bow hinge brackets of the vessel. The yoke is pivotably removably connectable at its tower end to hinges disposed on the lateral members of the counterweight frame.

The combination of fixed tower, slewing ring, suspension pendants, counterweight frame and hinged yoke frame between the vessel and the counterweight frame according to the invention, is an efficient structure providing restoring forces when the vessel is drifting due to wind and current, has wave induced surge, heave or pitch motions, has sway and yaw motions, or has roll motions.

BRIEF DESCRIPTION OF THE DRAWINGS

The invention is described in a preferred embodiment illustrated in the accompanying drawings wherein like elements are referred with the same reference numerals in the various figures in which:

FIG. 3 is a side view of the vessel and tower illustrating the restoring forces of the counterweights when the vessel undergoes drift, surge, heave and pitch motions;

FIG. 4 is an end view of the vessel and tower illustrating the restoring forces of the counterweights when the vessel undergoes sway and yaw motions; and FIG. 5 is an end view of the vessel tower illustrating the restoring force of the counterweights when the vessel undergoes roll motion.

DESCRIPTION OF THE INVENTION

Figure 1:
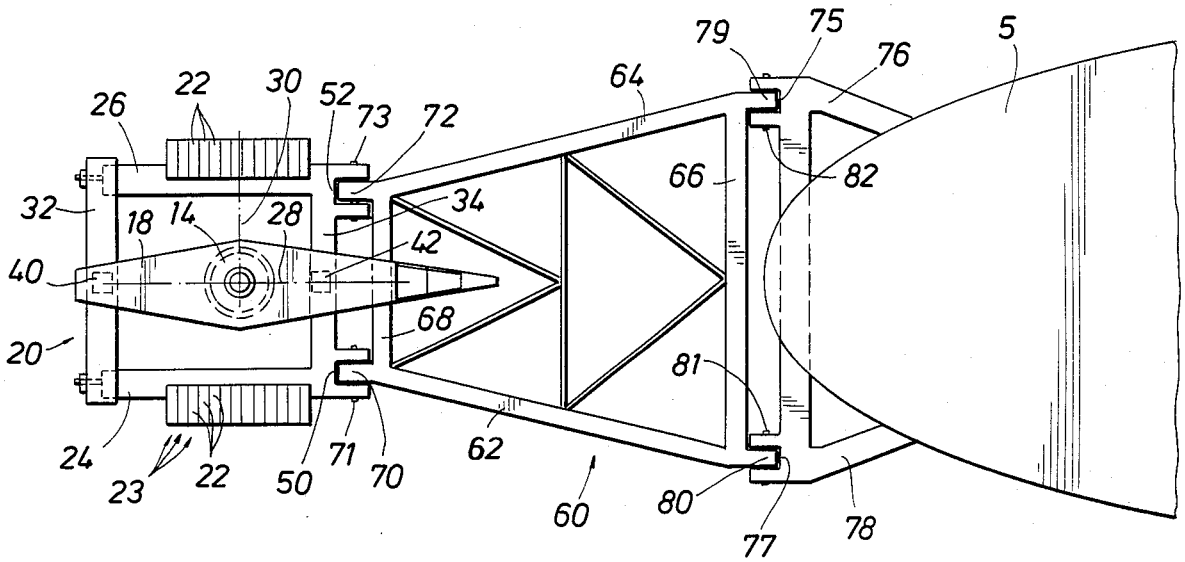
FIG. 1 is a plan view of the tower mooring structure illustrating a moored vessel, a yoke frame, a slewing boom and counterweight frame with counterweights by which the vessel is resiliently connected to the tower.
Figure 2:
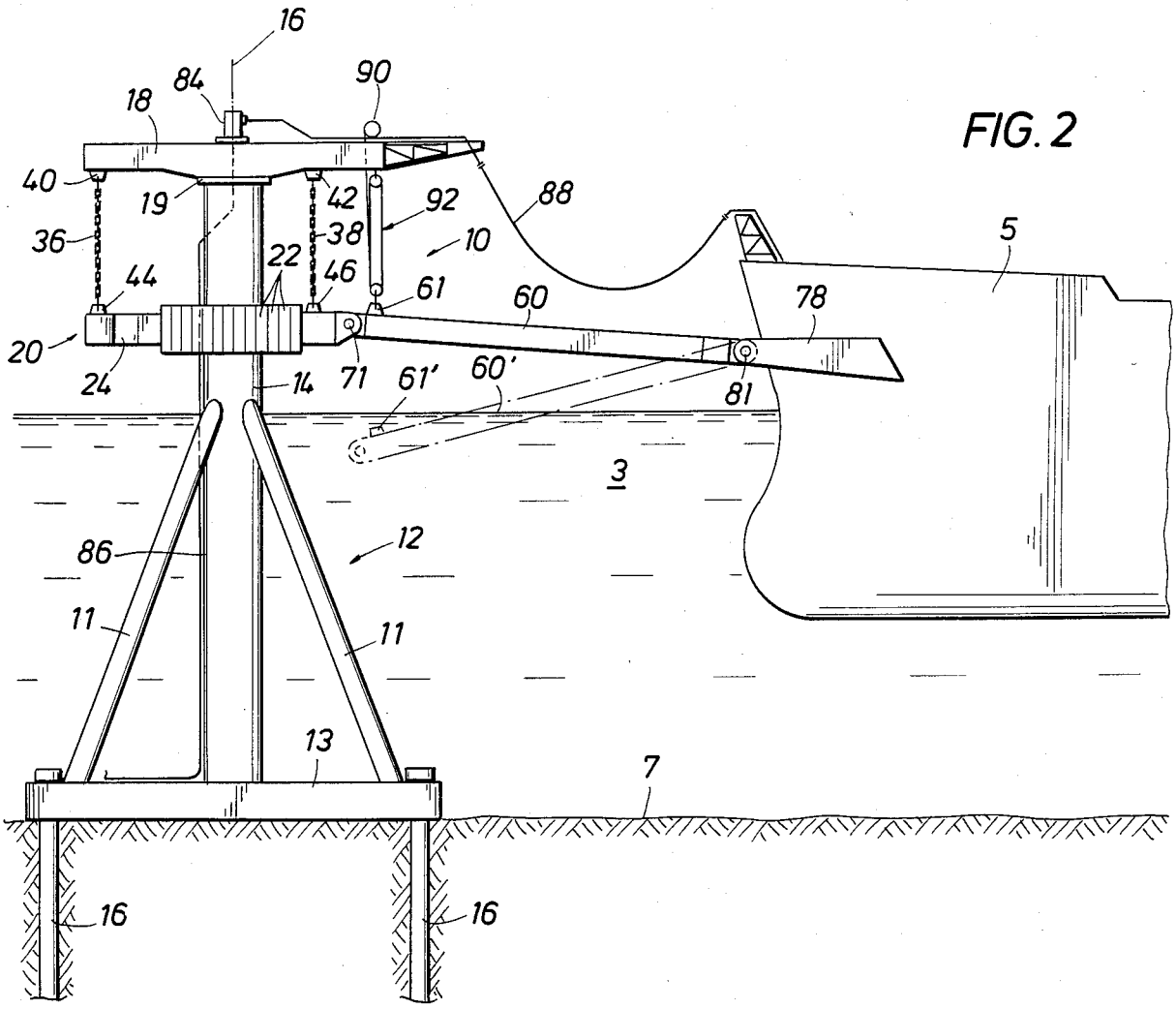
FIG. 2 is a side view of the tower showing the counterweight frame suspended from the slewing boom by means of suspension pendants and a slewing bearing, and removable hinges between the yoke frame and counterweight frame for disconnecting the yoke frame from the tower to a floating position for tanker departure.

FIGS. 1 and 2 illustrate respectively a plan view and a side view of a vessel 5 moored and disconnected from tower structure 12. The tower structure includes a base 13 fixed to the floor 7 of the body of water 3 by means of piles 16. A tower vertical shaft 14 having a tower vertical axis 16 is supported on base 13 by support members 11.

A slewing boom 18 is rotatably supported about the tower vertical shaft 14 by slewing bearing 19. As seen in FIG. 1, slewing boom 18 includes a longitudinal axis 28, substantially aligned with that of the vessel 5 and a lateral axis 30. Longitudinal axis 28 and lateral axis 30 are orthogonal to each other and to tower vertical axis 16.

A counterweight frame 20 comprising lateral members 32 and 34 and longitudinal members 24 and 26 is suspended from the slewing boom 18 by suspension pendants 36 and 38. Suspension pendants 36 and 38 are connected to the slewing boom along its longitudinal axis 28 preferably by means of universal joints 40 and 42. The suspension pendants 36 and 38 are connected to the counterweight frame 20 approximately midway along lateral members 32 and 34, preferably by means of universal joints 44 and 46. Suspension pendants 36 and 38 are preferably lengths of chains and although connection of the chains directly to the slewing boom 18 and counterframe 20 may function properly, the universal joints 44, 42, 44 and 46 prevent wear on terminating links of suspension pendants 36 and 38. Tubular members or wire ropes may be substituted for the preferred chains of suspension pendants 36, 38.

Counterweight blocks 22 may be inserted in counterweight accepting slots 23 fixed to longitudinal members 24 and 26. The restoring force of the counterweight frame may be adjusted by inserting counterweights 22 in slots 23 as needed.

Yoke frame 60 pivotly connects vessel 5 floating on the body of water 3 to counterweight frame 20. The yoke frame 60 is connected by hinges 77 and 75 to bow hinge brackets 78 and 76 which are fixed to the bow of the vessel. Preferably, the hinges 77 and 75 are formed by open U projections attached to brackets 76 and 78 in cooperation with projections 80 and 79 of outer members 62 and 64 of yoke frame 60. Projections 80 and 79 fit within the open U portion of hinges 77 and 75. Projections 80 and 79 are pivotably supported by hinge pins 81 and 82 which are essentially parallel to the lateral axis 30 and lateral member 32 and 34 of counterweight frame 20.

The yoke frame 60 is connected to counterweight frame 20 by hinges 50 and 52 formed by open U projections facing outwardly from lateral member 34. Projections 70 and 72 of frame 60 fit within the open U of the hinges 50 and 52 and are pivotably supported therein by hinge pins 71 and 73, which like pins 81 and 82, are parallel to lateral member 34 and lateral axis 30. As a result, the vessel 5 may move, heave and pitch with respect to counterweight frame 20 by virtue of the pivoting capability afforded by hinges 50 and 52 connecting the yoke frame 60 to counterweight 20 and by hinges 77 and 75 connecting the yoke frame 60 to vessel 5. The vessel may weathervane about the tower shaft 14 by virtue of the slewing bearing 19 bearingly supporting slewing boom 18 to tower vertical shaft 14. The vessel may also surge, yaw, sway and roll freely as the suspended counterweight frame, to which the yoke frame is attached, can accommodate all these motions within adequate limits.

FIG. 2 illustrates product piping 86 which is connected to product hose 88 via product swivel 84. Such hoses and swivel allow transfer of product between the vessel 5 and a subsea facility, such as a subsea oil and gas well.

FIG. 2 also illustrates apparatus for connecting and disconnecting vessel 5 from mooring tower 12. A winch 90 and yoke hoist lines 92 are connected to the tower end of yoke frames 60 at support collar 61. As the vessel 5 is approaching the tower 12 for mooring, support frame 60 floats in the water as shown at 60' in FIG. 2. The yoke hoist lines are attached to collar 61', and winch 90 pulls frame 60 upwardly until pins 71 and 73 may be inserted to pivotably connect the yoke frame 60 to lateral member 34 of counterweight frame 20. The process is reversed to disconnect yoke frame 60 from counterweight frame 20.

FIG. 3 illustrates restoring forces of the counterweight frame 20 in response to drift and surge forces $F_{d\ \&\ s}$ due to wind and current, and heave and pitch forces $F_{h\ \&\ p}$ due to tides and waves. The motion $M_{d\ \&\ s}$ results in horizontal movement of the counterweight frame suspended from universal joints 40 and 42, while the motion $M_{h\ \&\ p}$ in response to heave and pitch forces, results in rotational movement of the yoke frame about hinge axes parallel to lateral member 34 of counterweight frame 20. The longitudinal position restoring force F against drift and surge motions $M_{d\ \&\ s}$ results from the "pendulum effect" caused by the counterweights 22 in counterweight frame 20 suspended from slewing boom 18 by pendants 36 and 38.

FIG. 4 shows an end view of the tower 12 with the vessel 5 behind it. Sway and yaw motion $M_{s\ \&\ y}$ of the vessel is opposed by forces $F_t$ and $Q_t$ as illustrated by a similar pendulum effect about the longitudinal axis 28. These forces are traverse to restoring force F and Q of FIG. 3.

FIG. 5 illustrates roll motion of the vessel 5 with respect to the tower 12. The counterweight frame and thus the yoke frame 60 and vessel 5 are free to roll about the longitudinal pins or axis of the universal joints 44 and 46 attached to the counterweight frame. Simultaneously, the counterweight frame is free to accommodate lateral movements, induced by the rolling motion of the vessel, by swinging laterally in a similar manner as for sway and yaw motions.

Thus, there is provided an improved tower mooring structure for a vessel which provides resiliency to prevent high peak loads in the mooring system as the tanker moves in response to drift forces due to wind and current and to surge, sway, yaw, roll, heave and pitch motions due to storm wave actions.

Various modifications and alterations in the described structures will be apparent to those skilled in the art of the foregoing description which does not depart from the spirit of the invention. For this reason, these changes are desired to be included in the appended claims. The appended claims recite the only limitation to the present invention and the descriptive manner which is employed for setting forth the embodiments and is to be interpreted as illustrative and not limitative.

What is claimed is:

1. Structure for mooring a vessel having bow hinge brackets and floating on a surface of a body of water comprising a tower structure fixed to a floor of said body of water, said tower structure having a vertical axis, a slewing boom mounted to said tower structure for rotation about said vertical axis of said tower structure, said slewing boom having a longitudinal axis and a lateral axis, each of which is orthogonal to said vertical axis of said tower structure, a counterweight frame having a pair of longitudinal members disposed parallel to said longitudinal axis and a pair of lateral members disposed parallel to said lateral axis, a pair of suspension pendants connected between said lateral members and said slewing boom, the connection of said pendants to said slewing boom being along the longitudinal axis of said slewing boom, counterweights disposed on said pair of longitudinal members, a single unitary yoke frame pivotably connectable at its vessel end to the bow hinge brackets of the vessel; and hinge means disposed on one of said pair of said lateral members for pivotably connecting the tower end of said yoke frame to said tower structure.

2. The structure of claim 1 wherein each of said suspension pendants is connected to a lateral member by means of a universal joint and to said slewing boom by means of a universal joint.

3. The structure of claim 1 wherein said hinge means includes means for removably disconnecting said yoke frame from said counterweight frame.

4. The structure of claim 3 further comprising a winch and yoke hoist lines for raising or lowering said yoke frame during operation for connecting or disconnecting said vessel to or from said counterweight frame.

5. In a structure for mooring a vessel floating on the surface of a body of water including a tower structure fixed to the floor of the body of water, the vessel connected to the tower by means of a yoke assembly connected at its vessel end in a substantially horizontally pivotable manner to the vessel, the tower structure having a slewing boom rotatable around a vertical axis, the slewing boom having a lateral axis and a longitudinal axis substantially aligned with a longitudinal axis of the vessel, an improved structure for pivotably connecting the slewing boom to the tower end of the yoke assembly for providing a restoring force to the vessel comprising a counterweight frame having a pair of longitudinal members disposed parallel to the longitudinal axis of said slewing boom and a pair of lateral members disposed parallel to the lateral axis of said slewing boom, counterweights disposed on said pair of counterweight frame longitudinal members, a pair of suspension pendants connected between the lateral members and said slewing boom, the connections of said pendants to said slewing boom being along its longitudinal axis, and hinge means disposed on a lateral member of said counterweight frame for pivotally connecting the tower end of said yoke assembly to said tower.

6. The improved structure of claim 5 wherein said hinge means is releasably detachable from said yoke assembly thereby facilitating detachment and reattachment of said yoke to said tower.

7. The improved structure of claim 6 further comprising means for raising or lowering the tower end of said yoke from or to the water during connecting or disconnecting operations.

8. In a structure for mooring a vessel floating on a surface of a body of water including a tower structure fixed to a floor of the body of water, the vessel connected to the tower by means of a yoke assembly connected at its vessel end in a substantially horizontally pivotable manner to the vessel, the tower structure having a slewing boom rotatable around a vertical axis, the slewing boom having a lateral axis and a longitudinal axis substantially aligned with a longitudinal axis of the vessel, an improved structure for pivotably connecting the slewing boom to the tower end of the yoke assembly for providing a restoring force to the vessel comprising a counterweight frame having a pair of longitudinal members disposed parallel to the longitudinal axis of said slewing boom and a pair of lateral members disposed parallel to the lateral axis of said slewing boom, a pair of suspension pendants connected between said counterweight frame and said slewing boom, the connections of said pendants to said slewing boom being along its longitudinal axis, and hinge means disposed on one of said lateral member of said counterweight frame for pivotally connecting the tower end of said yoke assembly to said tower, said yoke assembly being a single unitary structure.

* * * * *